US005265282A

United States Patent [19]

Schmucki

[11] Patent Number: 5,265,282

[45] Date of Patent: Nov. 30, 1993

[54] ACTUATING DEVICE ON THE DRAIN VALVE OF A FLUSH TANK

[75] Inventor: Peter Schmucki, Eschenback, Switzerland

[73] Assignee: Geberit AG, Jona, Switzerland

[21] Appl. No.: 751,142

[22] Filed: Aug. 28, 1991

[30] Foreign Application Priority Data

Aug. 29, 1990 [CH] Switzerland ..... 2808/90-0

[51] Int. Cl.[5] ..... E03D 3/12; E03D 5/092

[52] U.S. Cl. ..... 4/325; 4/410; 4/414; 4/415

[58] Field of Search ..... 4/249, 324, 378, 405, 4/410, 413, 414, 415, 325, 391, 395, 397, 398

[56] References Cited

U.S. PATENT DOCUMENTS

| | | | |
|---|---|---|---|
| 2,795,237 | 6/1957 | Corbin | 137/433 |
| 4,571,753 | 2/1986 | Strangfeld | 4/324 |
| 4,956,880 | 9/1990 | Bailet | 4/378 X |

FOREIGN PATENT DOCUMENTS

| | | | |
|---|---|---|---|
| 0103045 | 3/1984 | European Pat. Off. . | |
| 3123501A1 | 1/1983 | Fed. Rep. of Germany . | |
| 3422315A1 | 1/1985 | Fed. Rep. of Germany . | |
| 3729569A1 | 3/1989 | Fed. Rep. of Germany | 4/324 |
| 8120799 | 6/1982 | France . | |

OTHER PUBLICATIONS

Abstract, English language for DT 3729569, Mar. 1989, Germany, Barthel.

*Primary Examiner*—William A. Cuchlinski, Jr.
*Assistant Examiner*—W. Morris Worth
*Attorney, Agent, or Firm*—McGlew and Tuttle

[57] ABSTRACT

The actuating device has a vertically displaceable trigger (9) which is mounted on a hood-shaped housing part (6*a*) of the drain valve (3). A lever (2), whose horizontal axis of rotation (5) is mounted on a float housing (6*b*), is pivoted with the trigger (9) in one or the other direction of rotation. To induce flushing, the trigger (9) is moved in the downward direction with a release knob (1) against the restoring force of a spring (24). The trigger (9) now engages a pivotable arm (9*b*), and the lever (2) is pivoted such that a valve tube (4) connected to the lever (2) is raised, and the valve opening (11*i*) is thus opened. If the release knob (1) is moved once again in the downward direction after a partial flushing, the trigger (9) will engage another pivot arm (2*a*), and the lever (2) will again be pivoted into the starting position, in which the outlet opening (11*i*) is closed.

10 Claims, 4 Drawing Sheets 1
34
34b
30b
34c
34a
35
40
30a
30
31
33
32a
32
4c
11i

ACTUATING DEVICE ON THE DRAIN VALVE OF A FLUSH TANK

FIELD OF THE INVENTION

The present invention pertains to an actuating device on a drain valve of a flush tank for a toilet or the like wherein the first actuation of the release knob by means of a switching device leads to an opening of the drain valve and the drain valve can be lowered into a closing position by repeated actuation of the release knob to interrupt flushing.

BACKGROUND OF THE INVENTION

Actuating devices of this type have become known from the Applicant's French publication FR-A-24,96,142 or German publication DE-A-34,22,315. These permit flushing of a toilet that can be interrupted and consequently allow the adjustment of the amount of flushing water to the particular case. It is thus possible to considerably reduce the fresh water consumption compared with the ordinary flush tank in which flushing cannot be interrupted. Since this is ecologically and economically meaningful and advantageous, flush tanks in which flushing can be interrupted have found widespread use. However, especially in the case of flush tanks made from ceramic, there is now a difficulty due to the fact that the mounting of such actuating devices is very complicated as a consequence of the large dimensional tolerances that are common. For example, it is necessary to cut two connecting rods to an exact size for mounting in the case of the actuating device according to the above-mentioned DE-A-34,22,315.

SUMMARY AND OBJECTS OF THE INVENTION

It is an object of the invention to provide an actuating device on the drain valve of a flush tank of the above-described class, which is easy to mount and yet simple and reliable in operation.

According to the invention, an actuating device on a drain valve of a flush tank includes a valve body moveable between a rest position and an upper position wherein the drain valve is opened when the valve body is pulled up and wherein the drain valve can be lowered into a closing position. The arrangement includes a release knob and switching means. The switching means is mounted on the drain valve and forms a single unit with the drain valve. The switching means is connected to the release valve for opening the drain valve by pulling up the valve body by first actuation of the release knob and lowering the drain valve into the closing position by a subsequent actuation of the release knob. The release knob preferably has a downwardly extending part which can be cut to a desired length and which loosely engages the switching device.

In the actuating device according to the present invention, the switching device is mounted on the drain valve and forms one unit with it. Since the switching device can consequently be fixed at the bottom of the flush tank together with the drain valve as a whole, the amount of installation work is substantially reduced, and automatic mounting is also possible without problems. Adjustment of the switching device to the drain valve during mounting is no longer necessary.

The release knob is mounted on the flush tank separated from this unit. Consequently, since the release knob no longer needs to be connected to the switching device during mounting, the release knob can also be fastened in a substantially simpler manner, e.g., on the lid of the flush tank.

Thus, the mounting of the actuating device according to the present invention is at least as simple as that of an ordinary actuating device that does not provide for interruption of flushing.

Since the release knob is mounted separately from the switching device, differences in the tank heights or misalignment of pipes between the lid and the bottom of the tank can be compensated for in a simple manner.

Adjustment to different tank heights can be achieved particularly simply by arranging a rod that can be cut off, to a desired size, on the release knob at its lower end.

If the switching device is arranged, according to a variant of the present invention, under a hood-shaped housing part, a particularly compact and functionally reliable unit is obtained.

According to a variant of the present invention, the switching device has a vertically displaceable trigger and a two-armed lever with deflectable switching arms. The trigger is moved vertically in the downward or upward direction, while the two-armed lever is pivoted clockwise or counterclockwise. Such a switching device operates practically without dead stroke.

Further advantageous characteristics will become apparent from the further dependent claims and the subsequent specification. Embodiments of the present invention will be explained in greater detail below on the basis of the drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
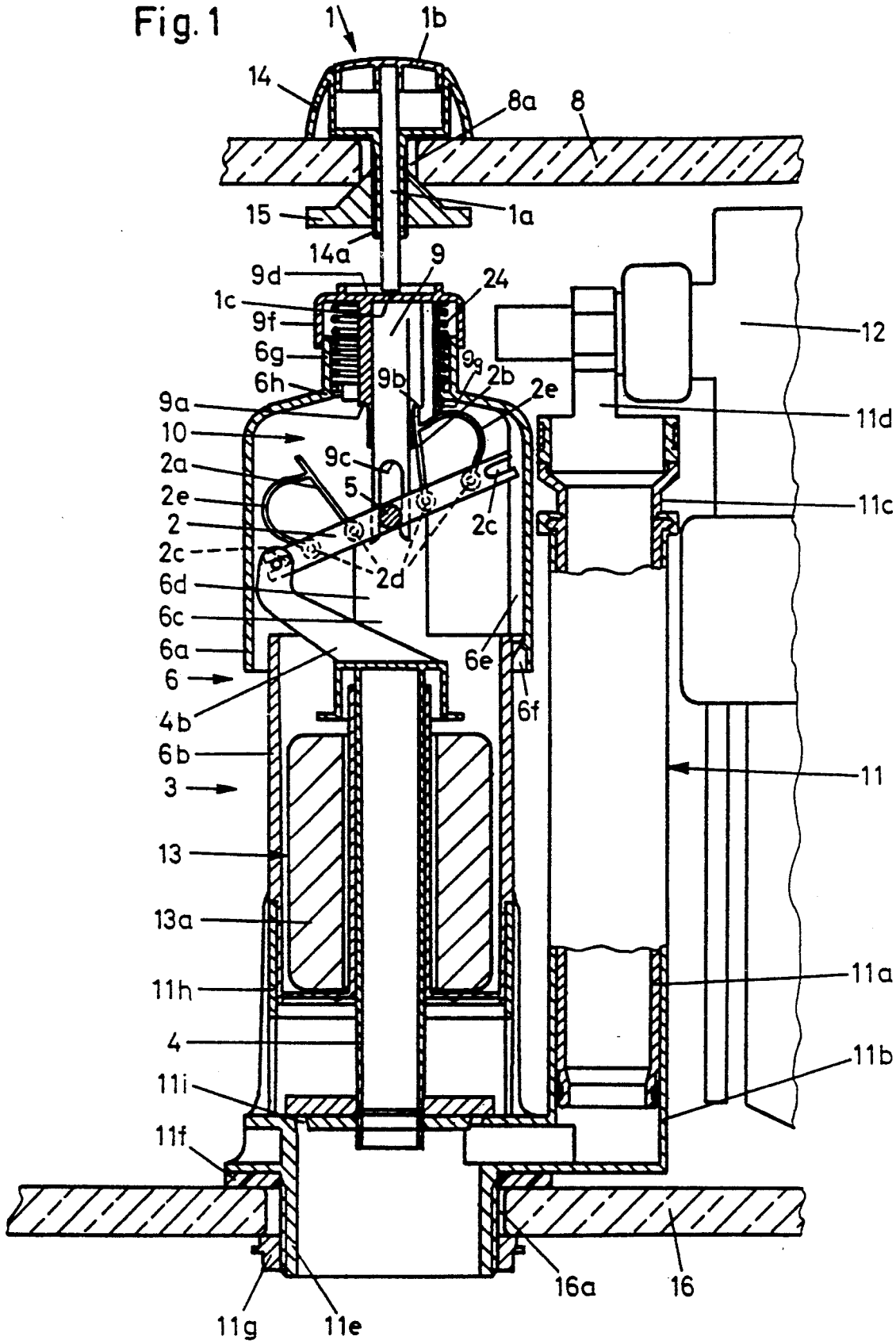
FIG. 1 is a partial vertical sectional view through a flush tank with an actuating device according to the present invention.

FIG. 1 shows an ordinary ceramic flush tank with a lid 8 and a bottom 16 of a tank body. A release knob 1 with a knob element 1*b* and a rod 1*a* connected to it are inserted into the opening 8*a* of the lid 8. The release knob 1 is guided vertically displaceably in a housing 14. The housing 14 is fixed on the flush tank lid 8 with a nut 15, which is screwed onto a guide sleeve 14*a* provided with external threads.

A drain valve 3, which has an overflow tube 11, a float valve 13 with a cylindrical float body 13*a*, and, in a housing 6, a switching device 10, is fastened to an opening 16*a* in the bottom 16.

A valve tube 4 with a valve disk 4*c* is mounted in a float housing 6*b*. By raising or lowering the valve tube 4, an outlet opening 11*i* of the drain valve 3 is opened or closed, respectively, to initiate flushing.

The float housing 6*b* is fastened on a base 11*h*, which is made in one piece with a drain connection 11*e*. The connection pipe 11*e* is in turn made in one piece with a tube 11*b* of the overflow 11, which is open at its top. The connection pipe 11*e* is passed through the opening 16*a* of the flush tank bottom 16 and is sealingly fastened on the flush tank bottom 16 by means of a lock nut 11*g* and a sealing washer 11*f*.

Another tube 11*c*, in the upper, broader end of which a holder 11*d* is lockingly fastened, is telescopically and lockingly inserted into the tube 11*b* of the overflow 11. An ordinary intake valve 12 is fastened on the holder 11*d*. By displacing the tube 11*c* in the tube 11*b*, it is possible to set the maximum water level in the flush tank.

Two opposite projections, which have, at the top end, one support 6*d* each for a horizontally extending axis of rotation 5 of a two-armed lever 2, are made in one piece with the top of the float housing 6*b*. The lever 2 has, at each end, a slot 2*c*, one of which forms a swivel joint with a pin 4*d* of an arm 4*b* made in one piece with the valve tube 4.

A hood-shaped housing part 6*a*, in which a trigger 9 cooperating with the lever 2 is mounted and has a plurality of inwardly projecting ribs 6*e* as well as locking cams 6*f*, with which the housing part 6*a* is locked on the float housing 6*b*, is detachably or permanently arranged above the housing 6*b*.

A cylindrical collar 6*g*, which has an inwardly projecting edge 6*h* for receiving a coil spring 24, is made in one piece with the top of the housing part 6*a*. With a trigger bar, the trigger 9 extends through the collar 6*g* into the interior of the housing part 6*a* and is guided, at the lower end, vertically displaceably with a guide slot 19 on the axis 5 of the lever 2. At the top end, a cylindrical guide part 9*f* is made in one piece with the trigger 9; the guide part surrounds the collar 6*g*, and the coil spring 24 lies against its top end. To actuate the drain valve 3 with the release knob 1, the trigger 9 can be moved vertically in the downward direction against the restoring force of the spring 24 until the guide part 9*f* is stopped by the collar 6*g*. When the release knob 1 is released, the spring 24 moves the trigger 9 in the upward direction until a cam 9*g* strikes the housing part 6*a*.

Two shoulders 9*a* and 9*b*, which engage a pivot arm 2*a* or 2*b*, depending on the pivoted position of the lever 2, are made in one piece with the trigger bar. The pivot arms 2*a* and 2*b* are pivotably mounted on the lever 2 by means of the two swivel joints 2*d*. Spring parts 2*e* made in one piece return the pivot arms 2*a* and 2*b* into a predetermined position in the released state.

The lower end of the release knob 1 lies loosely on a flat surface 9*d* of the trigger 9. The horizontally extending surface 9*d* is substantially larger than the support surface 1*c* of the release knob, so that a lateral displacement between the release knob 1 and the drain valve 3 is possible. A misalignment that may exist between the openings 8*a* and 16*a* can be compensated for due to such a displaceability. Later displacement of the lid 8 during the use of the flush tank also fails to affect the reliability of the actuation, because, as can be seen, the release knob is able to yield to the side.

Figures 2A, 2B, 2C, 2D:
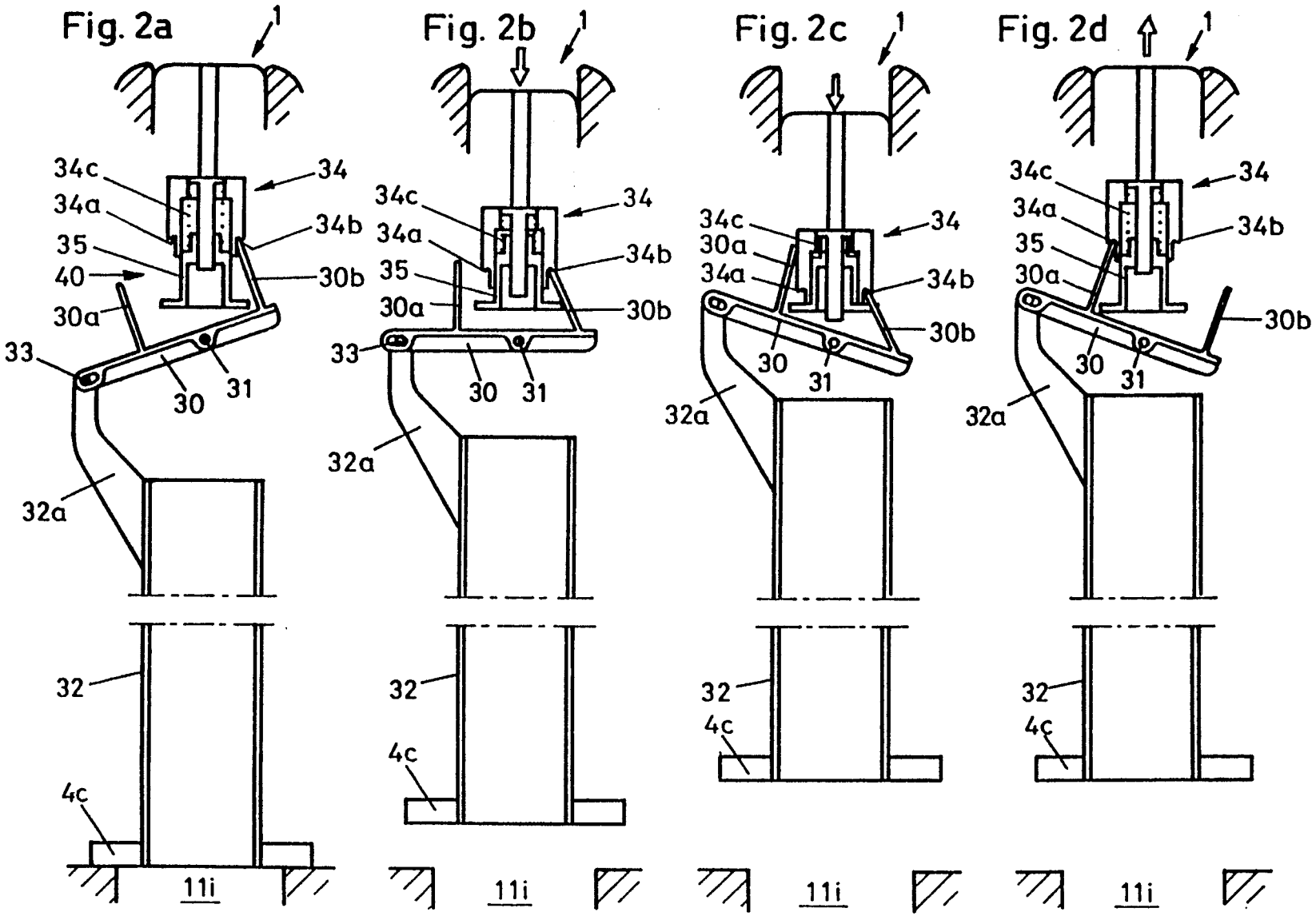
FIGS. 2*a* through 2*d* are views showing schematically the mode of operation of one variant of an actuating device.

FIG. 2*a* shows an embodiment in which an arm 32*a* is made laterally in once piece with a valve tube 32, and the arm 32*a* is connected via a swivel joint 33 to a two-armed lever 30. The lever 30 is pivotably mounted on a horizontal shaft 31, which corresponds to the axis 5. Depending on the position of the valve tube 32, elastic arms 30*a* and 30*b* projecting vertically from the lever 30 engage a shoulder 34*a* or a shoulder 34*b* of a trigger 34. The trigger 34 can be moved in the downward direction against the force of a coil spring 34*c*, guiding a guide part 35 rigidly connected to the drain valve. The function of the trigger 34 corresponds to that of the trigger 9. The other parts of the actuating device, which are not shown here, are designed as described in FIG. 1.

The mode of operation of the actuating device will be explained below on the basis of FIGS. 2*a* through 2*d*.

In the position of the actuating device shown in FIG. 2*a*, the outlet opening 11*i* is closed by the valve disk 4*c*. If the trigger 34 is moved downward against the restoring force of the spring 34*c* with the release knob 1 to induce flushing, the two-armed lever 30 is pivoted around its axis 31 into the horizontal position shown in FIG. 2*b*, and finally into the position shown in FIG. 2*c*. The valve tube 32 with the valve disk 4*c* is lifted, and the outlet opening is opened. The flushing water present in the flush tank enters the toilet bowl through the outlet opening. As is clearly shown in FIGS. 2*a*–2*c*, the arm 30*b* is engaging the trigger 34 during this pivoting movement. In the position according to FIG. 2*c*, the other pivot arm 30*a* is elastically in contact with the trigger 9, and is slightly deflected.

If the release knob 1 is now released in the position shown in FIG. 2*c* after complete or partial emptying of the flush tank, the trigger 34 moves upward into the position shown in FIG. 2*d* under the effect of the coil spring 34*c*. Due to the buoyancy of the float, the valve tube 32 now remains in the open position. At the same time, the pivot arm 30*a* slides along the trigger 34 and finally snaps into the shoulder 34*a*. If the release knob 1 is now again moved in the downward direction, the two-armed lever 30 will move back into the pivoted position shown in FIG. 2*a*. The valve disk 4*c* is thus also moved in the downward direction, and the outlet opening will be closed. The partially or fully emptied flush tank is now refilled via the inlet valve 12 in the known manner. The flush tank is now again ready for partial or complete flushing.

Figure 3A:
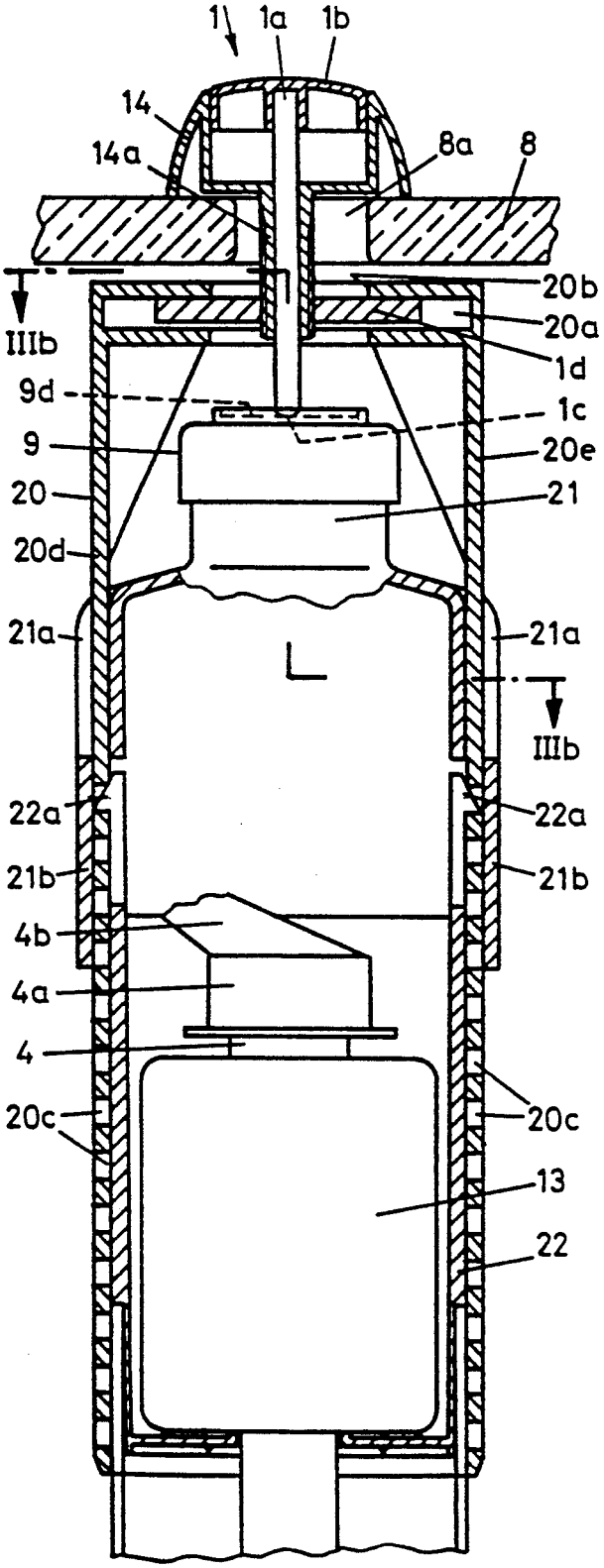
FIG. 3*a* is a sectional view taken through another variant of an actuating device.
Figure 3B:
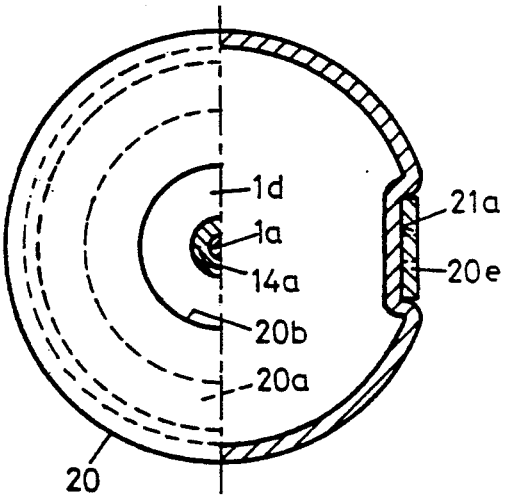
FIG. 3*b* is a sectional view taken along line IIIb—IIIb in FIG. 3*a*.

FIGS. 3*a* and 3*b* show an embodiment of the actuating device according to the present invention, in which the flush tank lid 8 is fastened to the housing of the drain valve. The switching device, not shown, may correspond to the above-mentioned switching device 10 or 40. A yoke 20 has two downwardly extending arms 20*d* and 20*e*, which have a plurality of openings 20*c* arranged in a row. Two locking cams 22*a*, made in one piece with a float housing 22, snap into one of the openings each. The arms 20*d* and 20*e* are placed into a lateral depression 21*a* and extend behind a jacket part 21*b* of the hood 21 at the level of the cams 22*a*. Beneath the hood 21, the arms 20*d* and 20*e* are externally in contact with the float housing 22. The float housing 22, the hood 21, and the yoke 20 are thus rigidly connected to one another in the form of boxes, and the height of the yoke 20 can be adjusted as desired corresponding to the openings 20*c*. At the top end of the yoke 20, an opening 20*b* is provided, through which the release knob 1 as well as the guide sleeve 14*a*, which is made in one piece with the housing 14, extend. A disk 1*d*, which is inserted from the side into a chamber 20*a* of the yoke 20 and connects the yoke 20 to the housing 14, is screwed onto the external threaded section of the guide sleeve 14*a*. By turning the housing 14 around the longitudinal axis of the guide sleeve 14*a*, the yoke 20 and consequently the entire drain valve can be tensioned with the lid. By correspondingly rotating the housing 14 in the opposite direction, the housing is detached from the disk 1*d*, after which the lid 8 can be lifted off. The function of the actuating device, which is described on the basis of FIG. 1 as well as FIGS. 2*a*–2*d*, is fully guaranteed in the case of this manner of fastening the lid as well.

Figures 4A, 4B, 4C, 4D:
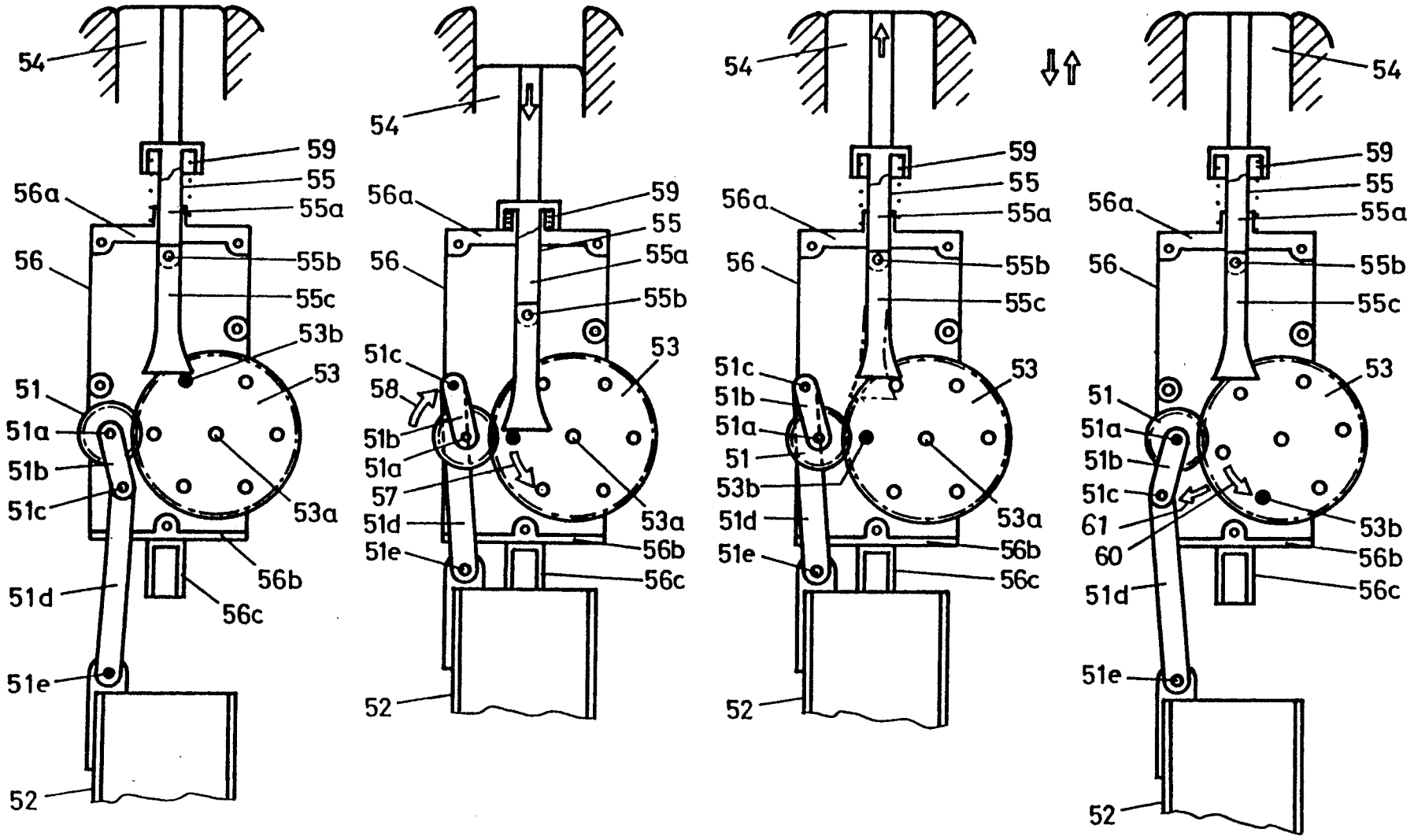
FIGS. 4*a* through 4*d* are views showing schematically the mode of operation of another variant of the actuating device.

The variant of the actuating device shown in FIGS. 4*a*–4*b* is also provided preferably for a flush tank made of ceramic and also permits flushing to be interrupted by repeated movements of the release knob 54 in the same direction. According to FIG. 1 or FIG. 3*a*, the release knob 54 is mounted on the flush tank lid, not shown here. It can be cut to a desired length, and its front end stands on the head 55*a* of a trigger 55.

The trigger 55 is guided vertically displaceably in a holder 56 and can be moved with the knob 54 by a limited amount in the downward direction against the force of a coil spring 59. The spring 59 is supported on the head 55*a* and the holder 56*a*. An arm 55*c*, which can be pivoted out to the side, is arranged on the head 55*a* via a swivel joint 55*b*. The holder 56 has a guide part 56*a* for the trigger 55, a bottom part 56*b*, as well as a strap 56*c*. The holder 56 is detachably or permanently connected by the strap 56*c* to the housing (not shown here) of the drain valve. Similarly to what is shown in FIG. 1, the holder 56 may also be arranged under a hood here.

A disk 53 with a plurality of laterally projecting cams 53*b*, as well as a smaller disk 51 are rotatably mounted on the plate-or box-shaped holder 56. The smaller disk 51 engages the larger disk 53, and is connected to the valve tube 52 via the levers 51*b* and 51*d*. One end of the lever 51*b* is rigidly connected to the disk 51, and its other end is hinged to the substantially longer arm 51*d*. The lever 51*d* in turn is connected to the valve tube 52 via a hinge 51*e*.

The mode of operation of the actuating device will be explained in greater detail below on the basis of FIGS. 4*a*–4*d*.

In FIG. 4*a*, the actuating device is in the basic position, and the drain valve is consequently closed, and it is assumed that the flush tank is filled. If the release knob 54 is now moved in the downward direction to induce flushing, the trigger 55 is also moved downward at the same time against the force of the spring 59. The trigger 55 standing on a cam 53*b* at the other end will now also rotate disk 53 through 60° counterclockwise in the direction of the arrow 57. According to FIG. 4*b*, the driven smaller wheel 51 rotates through 180° in the clockwise direction in the direction of the arrow 58. As a result, via the lever 51*d*, the valve tube 52 is lifted correspondingly in the upward direction, and the drain valve is opened. Flushing is thus initiated, and the flush tube 52 temporarily remains in the position shown in FIG. 4*b* due to the buoyancy of the float. The release knob 54, which is released, and the trigger 55 are returned into the original position shown in FIG. 4*a* by the restoring force of the spring 59. As is shown in FIG. 4*c*, the arm 55*c* is brought, by lateral deflection, into a position in which it stands above another cam of the disk 53.

If flushing is not interrupted, the valve tube 52 drops back into the closing position in the usual manner after emptying of the flush tank, and at the same time, the smaller wheel 51 rotates further through 180° in the direction of arrow 61, and will again reach the position shown in FIG. 4*a*. After the flush tank has been refilled, it is ready for the next flushing.

However, if the release knob 54 is again moved downward in the same direction to interrupt flushing, the switching arm 55*c* rotates the disk 53 through 60° in the counterclockwise direction, and the smaller wheel 51 rotates further through 180° from the position shown in FIG. 4*c* in the direction of arrow 61, and the valve tube 52 is pressed in the downward direction onto the valve seat against the buoyancy of the float. As a result, the drain valve is closed after partial emptying of the flush tank, and the actuating device has again reached the starting position according to FIG. 4*d*. After the flush tank has been refilled, flushing can be induced in the above-described manner.

While specific embodiments of the invention have been shown and described in detail to illustrate the application of the principles of the invention, it will be understood that the invention may be embodied otherwise without departing from such principles.

What is claimed is:

1. An actuating device for a drain valve of a flush tank, comprising: a flush tank base defining a drain valve seat; a flush tank lid disposed above said base; a float housing positioned above said drain valve seat, between said flush tank base and said flush tank lid; a valve body moveable between a rest position, wherein said valve body is seated in said drain valve seat, and an upper position wherein said valve body is spaced from said drain valve seat, said valve body being mounted in said float housing; switching means mounted on said float housing and forming a single unit with said float housing, and fastened for movement of said valve body between said rest position and said upper position, said switching means including a trigger and a lever, said lever being pivotable in a first direction for raising said valve body to move said valve body between said rest position and said upper position, and pivotable in a second direction, lowering said valve body for moving said valve body between said upper position and said rest position, said trigger being moveable downwardly to engage said lever to pivot said lever in said first direction when said valve body is in said rest position, and being movable downwardly to engage said lever to move said lever in said second direction when said valve body is in said upper position, for switching a direction of movement of said valve body upon downward movement of said trigger, depending upon a position of said valve body; and release knob means for moving said trigger downwardly, said release knob means including a release knob fixed on said flush tank lid for downward movement relative thereto and being vertically moveable from outside of said flush tank, and a downwardly extending part extending through an opening of said flush tank lid, said downwardly extending part being cut to a desired length to abut an upper surface of said trigger thereby imparting downward movement between said flush knob and said trigger without fixedly connecting said downwardly extending part and said trigger.

2. An actuating device according to claim 1, wherein said release knob downwardly extending part lies on a horizontally extending support surface of said trigger.

3. An actuating device according to claim 1, wherein said switching means is arranged in a hood-shaped housing part of said float housing.

4. An actuating device according to claim 3, wherein said hood-shaped housing part is detachably fastened to said float housing.

5. An actuating device according to claim 4, wherein said hood-shaped housing part is detachably connected to said flush tank lid via a yoke.

6. An actuating device according to claim 1, wherein said lever includes a first pivot arm and a second pivot arm, said lever having a horizontal pivot axis, said first pivot arm being positioned on one side of said horizontal pivot axis and said second pivot arm being positioned on another side of said horizontal pivot axis, said trigger being engageable with said first pivot arm in one pivoted position of said lever and engageable with said second pivot arm in another pivoted position of said lever.

7. An actuating device according to claim 6, wherein trigger is mounted on a hood-shaped housing part detachably fastened to said float housing.

8. An actuating device according to claim 1, wherein said drain valve includes an overflow positioned outside of said float housing, an intake valve is provided fastened to said overflow.

9. An actuating device according to claim 8, wherein said overflow is provided as an overflow tube.

10. An actuating device for a drain valve of a flush tank, comprising: a flush tank base defining a drain valve seat; a flush tank lid disposed above said base; a float housing positioned above said drain valve seat, between said flush tank base and said flush tank lid; a valve body moveable between a rest position, wherein said valve body is seated in said drain valve seat, and an upper position wherein said valve body is spaced from said drain valve seat, said valve body being mounted in said float housing; switching means mounted on said float housing and forming a single unit with said float housing, and fastened for movement of said valve body between said rest position and said upper position, said switching means including a lever and a trigger, said lever being pivotable in a first direction for raising said valve body to move said valve body between said rest position and said upper position, and pivotable in a second direction, lowering said valve body for moving said valve body between said upper position and said rest position, said lever being positioned within said float housing, said trigger being moveable axially downwardly to engage said lever to pivot said lever in said first direction when said valve body is in said rest position, and being movable downwardly to engage said lever to move said lever in said second direction when said valve body is in said upper position, for switching a direction of movement of said valve body upon downward movement of said trigger, depending upon a position of said valve body, said trigger being axially movably supported by said float housing; and release knob means for moving said trigger downwardly, said release knob means including a release knob movably connected to said flush tank lid and being vertically moveable from outside of said flush tank, and a downwardly extending part being cut to a desired length to abut an upper surface of said trigger thereby imparting downward movement between said flush knob and said trigger without fixedly connecting said downwardly extending part and said trigger.

* * * * *